US006554458B1

(12) United States Patent
Benghozi

(10) Patent No.: US 6,554,458 B1
(45) Date of Patent: Apr. 29, 2003

(54) RECESSED LIGHT FIXTURE

(75) Inventor: Simon-Victor Benghozi, Outremont (CA)

(73) Assignee: Bazz, Inc., Montreal (CA)

( * ) Notice: Subject to any disclaimer, the term of this patent is extended or adjusted under 35 U.S.C. 154(b) by 0 days.

(21) Appl. No.: 09/942,144

(22) Filed: Aug. 29, 2001

(51) Int. Cl.[7] ..... F21S 8/04

(52) U.S. Cl. ..... 362/365; 362/148; 362/364; 362/366; 362/147

(58) Field of Search ..... 362/147, 148, 362/364, 365, 366, 368; D26/39, 72, 74, 75, 79, 83

(56) References Cited

U.S. PATENT DOCUMENTS 4,293,895 A * 10/1981 Kristofek ..... 248/27.1
5,377,088 A 12/1994 Lecluze ..... 362/366
5,609,414 A 3/1997 Caluori ..... 362/366
5,941,625 A * 8/1999 Morand ..... 248/343

* cited by examiner

*Primary Examiner*—Sandra O'Shea
*Assistant Examiner*—Hargobind S. Sawhney
(74) *Attorney, Agent, or Firm*—Nicholas D. Doukas; Godfrey & Kahn, S.C.

(57) ABSTRACT

A recessed light fixture for mounting into an opening made in a ceiling, wall or the like comprises a pot having a peripheral edge abutting the area adjacent a hole made in the ceiling or wall and one or more retaining clips for securing the fixture to the ceiling, wall or the like. Each retaining clip comprises an upper connecting portion with a threaded hole extending therethrough and a lower spring action adapted to contact the rear wall surface of the ceiling, wall or the like. A bolt extends through the threaded hole of the upper connecting portion and its actuation causes the clip to move in and out of a securing contact with the ceiling, wall or the like.

8 Claims, 4 Drawing Sheets

RECESSED LIGHT FIXTURE

FIELD OF THE INVENTION

The present invention relates to light fixtures and, in particular, to a recessed light fixture having one or more adjustable retaining clips for securing the fixture to a ceiling, wall or the like.

BACKGROUND OF THE INVENTION

Recessed light fixtures used in residential and/or commercial premises are well known. They are installed within a ceiling, wall or the like so that only the flange portion of the fixture lies flat with the wall surface. Their aesthetic and functional advantages are also well known; for example, such light fixtures are found described in U.S. Pat. No. 5,377,088 issued Dec. 27, 1994 to Lecluze and U.S. Pat. No. 5,609,414 issued Mar. 11, 1997 to Caluori.

OBJECTS AND STATEMENT OF THE INVENTION

It is an object of the present invention to provide an improved recessed light fixture, also known as pot lights, which is easy to use and which is installed independently of the thickness of the ceiling or wall.

It is also an object of the present invention to provide a recessed light fixture which does not need to be secured to a joist, cross-piece or mounting frame.

This is achieved by providing a recessed light fixture which comprises:

a) a pot adapted to be received in the ceiling or wall opening; the pot having an inner rear wall and a side wall; the side wall having an outer peripheral flange adapted to bear against the front wall surface when mounted in the opening; the side wall displaying slot means therein;

b) retaining clip means consisting of an elongated body having i) a main portion adapted to lie exteriorly along the side wall;

ii) an upper connecting portion extending substantially parallel to the inner rear wall of the pot and through the slot means; the upper connecting portion displaying a threaded hole therethrough;

iii) a lower spring portion defining a V-shape and extending through the slot means; the spring portion having a lower extremity adapted to contact the rear wall surface of the ceiling, wall or the like; the spring portion being flexible to move between a compressed condition and a detent condition;

c) an adjusting bolt having a head and an elongated threaded stem adapted to extend through the threaded hole of the upper connecting portion of the clip means and to contact the rear wall of the pot;

wherein the spring portion, in the compressed condition, is installed in the slot means to extend in the pot and to secure the clip means in the side wall;

wherein the spring portion, in the detent condition, extends exteriorly of the side wall and over the rear wall surface of the ceiling, wall or the like; and wherein rotation of the bolt causes the clip means to move longitudinally relative to the side wall and the lower and upper end portions of the clip to move longitudinally in the slot means until the lower extremity of the clip contacts the rear wall surface to fixedly install the pot in the ceiling, wall or the like.

In one form of the invention, the side-wall of the pot is provided with two vertically aligned slots through which extends upper and lower parts of the clip.

In a preferred form of the invention, a pair of clips are provided in corresponding slots in diametrically opposite sides of the pot.

Other objects and further scope of applicability of the present invention will become apparent from the detailed description given hereinafter. It should be understood however that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

In the appended drawings:

FIG. 3 is a cross-sectional view showing the insertion of the light fixture made in accordance with the present invention in a ceiling, wall or the like;

DESCRIPTION OF THE PREFERRED EMBODIMENT

Figure 1:
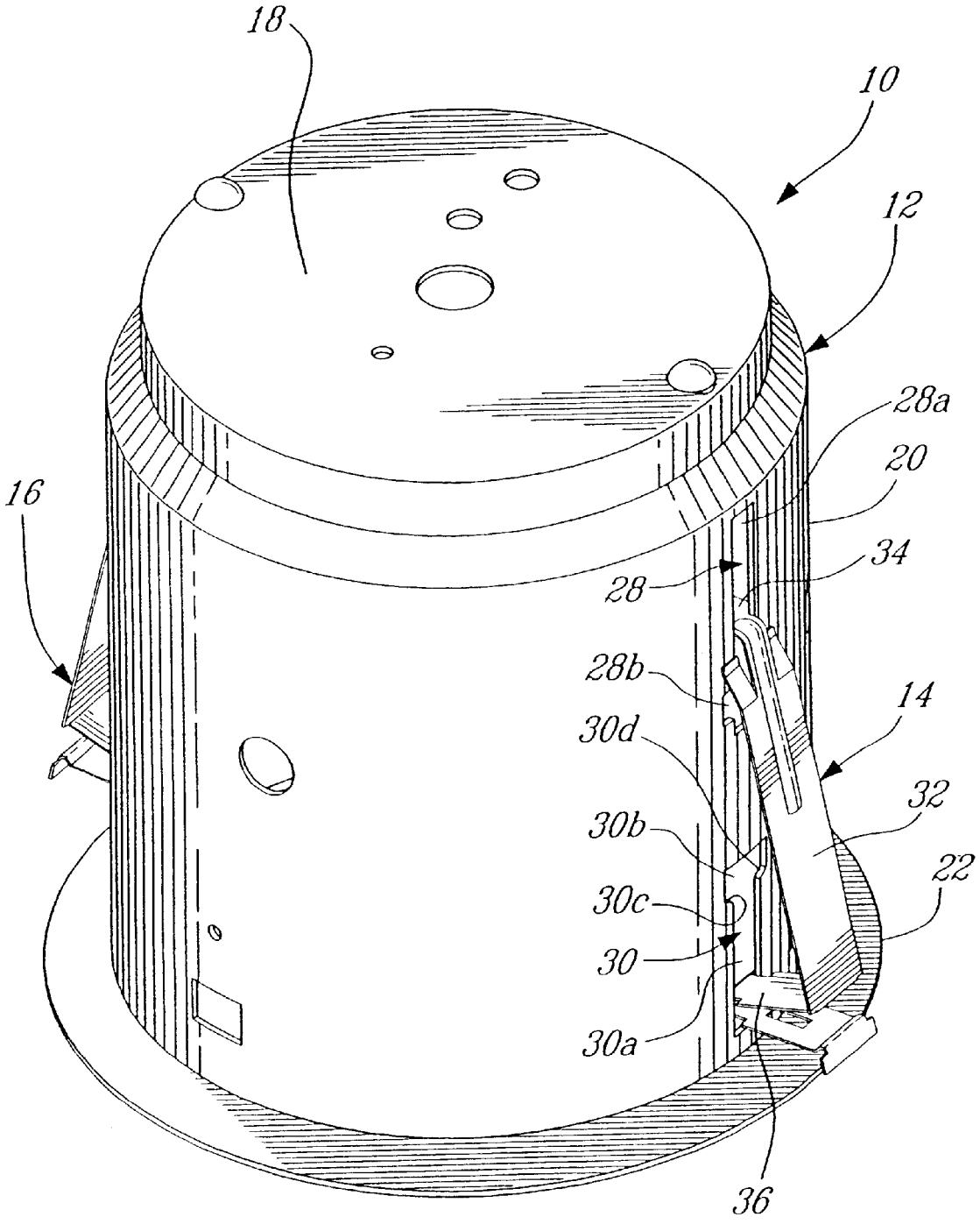
FIG. 1 is a top perspective view of a recessed light fixture made in accordance with the present invention, showing the retaining clip in a detent condition.
Figure 2:
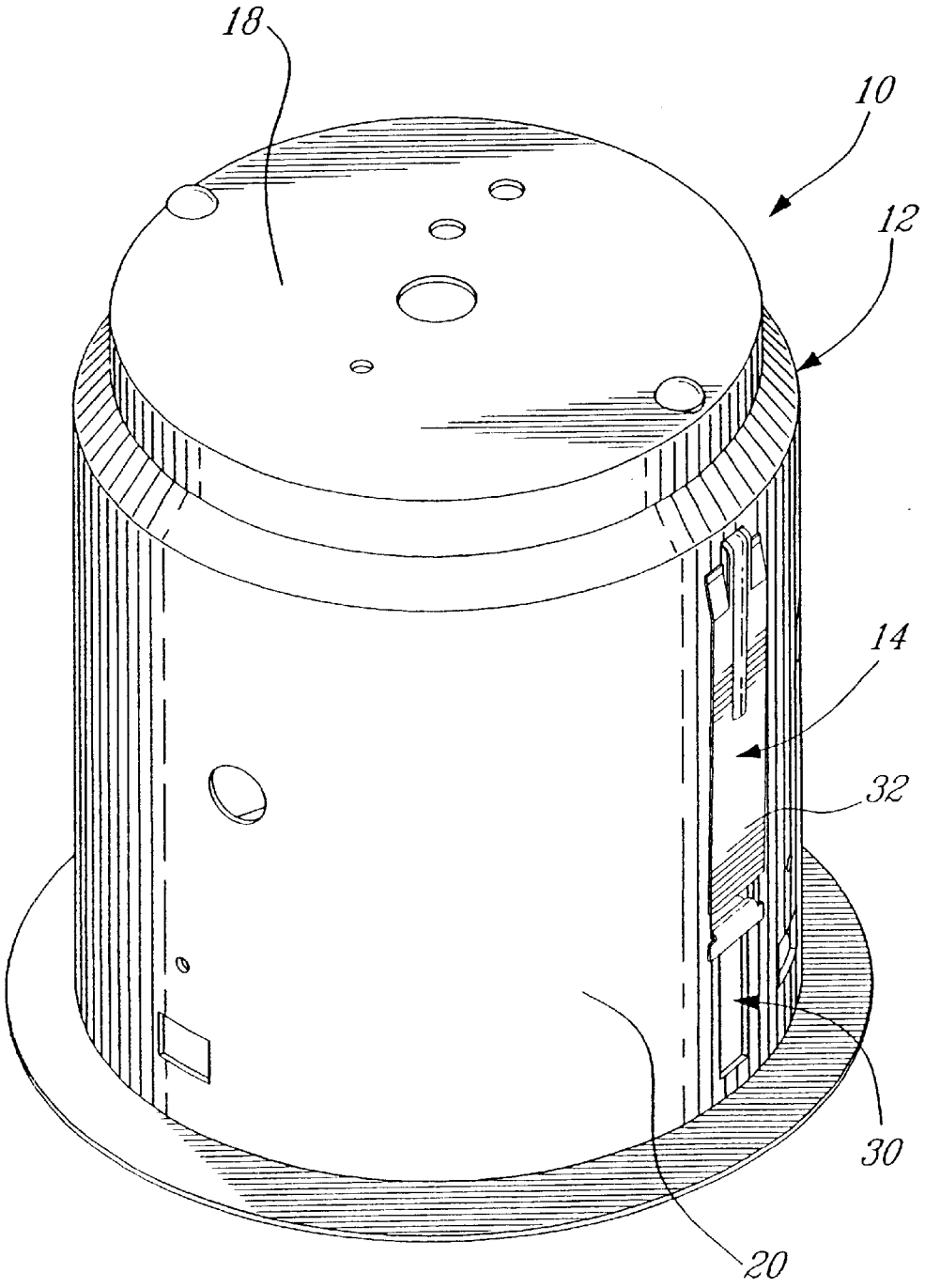
FIG. 2 is a perspective view of the pot shown in FIG. 1 showing the retaining clip in a compressed condition.

Referring to FIG. 1, there is shown a recessed light fixture, generally denoted 10, consisting of a pot 12 and a pair of diametrically opposite retaining clips 14 and 16. The retaining clips 14 and 16 being identical, a description of one only will be given.

The pot 12 has a rear or inner wall 18 and a side wall 20 displaying a lower peripheral flange 22 which is adapted to contact the front surface 24 (see FIGS. 3 and 4) of a ceiling, wall or the like 26. The side wall 20 displays, diametrically opposite to one another, a pair of aligned slots 28 and 30 extending in the axial direction of the pot. In the embodiment illustrated, the uppermost slot 28 displays a rectangular shaped opening **28*a* and an enlarged rectangular shaped lower opening 28*b* while the lowermost slot 30 displays a rectangular shaped area 30*a* and a slightly enlarged upper area 30*b***.

Figure 5:
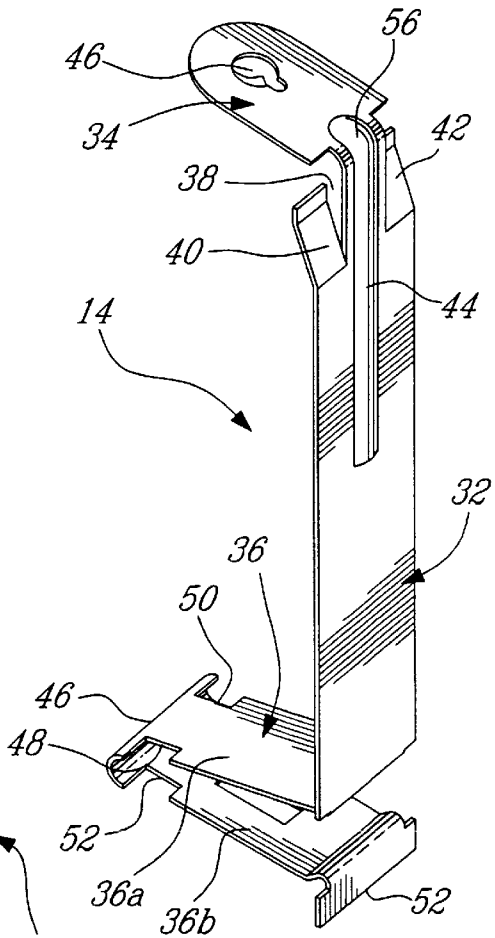
FIG. 5 is a perspective view showing the retaining clip.

Referring to FIG. 5, the retaining clip 14 comprises an elongated body having a main longitudinal portion 32, an upper bent connecting portion 34 and a lower portion 36 having a V-shape. The upper end area of the main portion 32 is provided with slits 38 to define a pair of wing slightly bent portions 40 and 42, the function of which will be described hereinbelow. The main portion 32 also includes a thicker rib area 44 that provides rigidity to the clip. The upper end portion 34 displays a threaded hole 46, the function of which will be given hereinafter.

The V-shape lower portion 36 consists of two legs **36*a* and 36*b* which are connected by a rounded elbow area 46. Each leg 36*a*, 36*b* displays a pair of vertically spaced indentations (three being shown as 48, 50 and 48'). The lower most leg 36*b* displays a lower downwardly turned extremity 52 which is adapted to bear against the rear surface 54 of the wall 26**.

As seen in FIG. 1, the upper slot 28 of the pot has a width slightly greater than the width of the corner area 56 of the clip so that area 56 may slide vertically in the slot 28 while the wings 40 and 42 of the main portion 32 slide along the wall 20 of the pot. The width of the enlarged area 28*b* of the upper slot is slightly greater than the width of the upper connecting portion 34 of the clip to enable transverse insertion of the connecting portion 34 in and out of this opening 28*b*. Similarly, the width of the slot portion 30*a* of the lower slot 30 is slightly larger than the width between the opposite indentations 48, 50, 48' so that the lower end portion of the clip may slide vertically in the slot 30. The width of the upper area 30*b* of the lower slot 30 is slightly larger than the width of the legs 36*a* and 36*b* so that these legs can move transversally in and out of the slot area 30*b*. The installation of the retaining clip to the pot shown will now be described with reference to FIG. 3.

Figure 3:
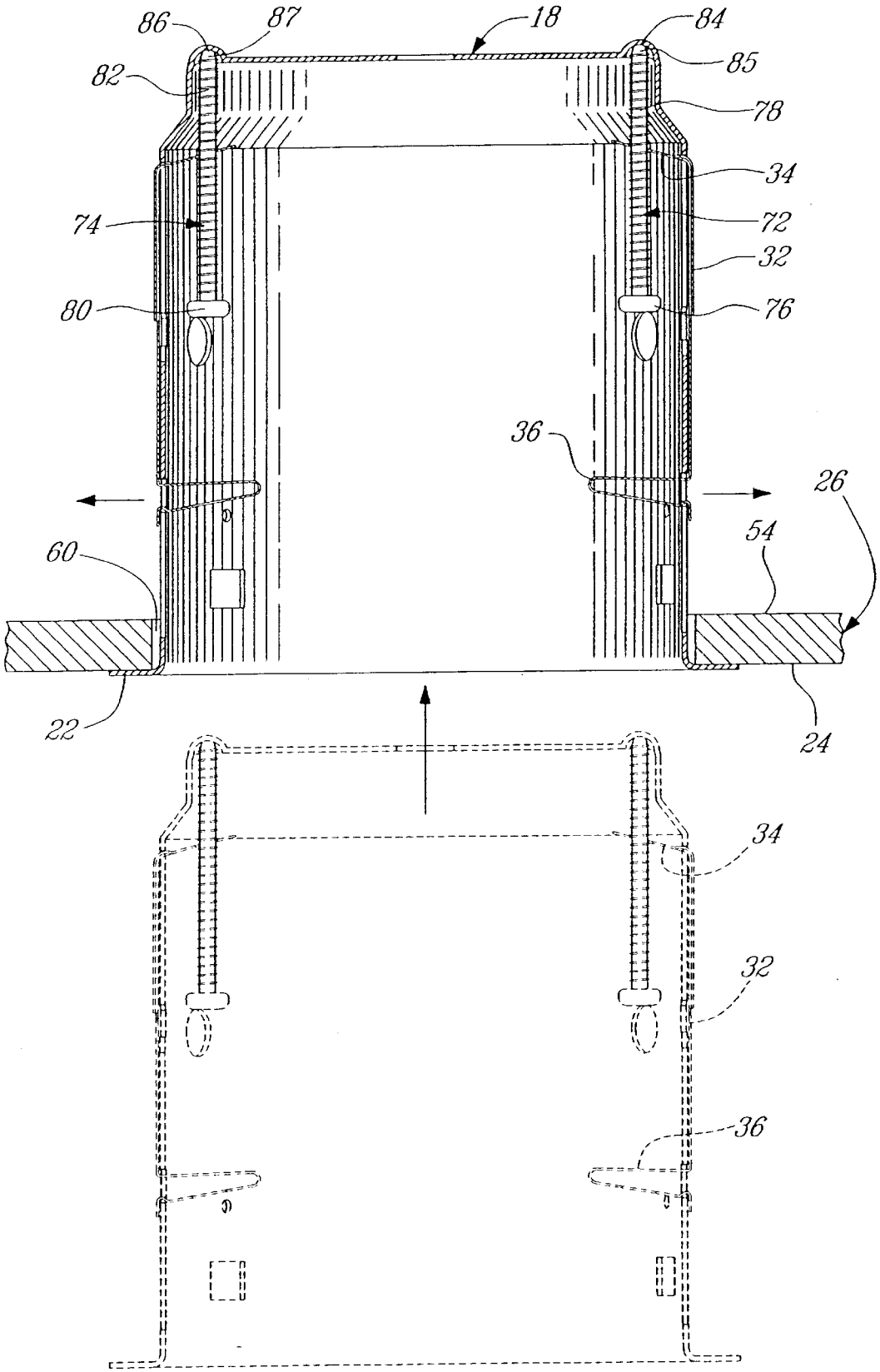

First, the upper end connecting portion 34 of each clip is inserted into the enlarged area 28*b* and the clip is slipped upwards until the lower end portion 36 of the clip faces the enlarged area opening 30*b* of the pot wall. The lower leg 36*b* is compressed so that the V-shaped portion 36 of the clip may fit into the opening 30*b* as illustrated in FIG. 3. In this position, the clip is prevented from sliding down the slots since the lower leg 36*b* bears against the shoulder areas 30*c* and 30*d* of the slots. Hence, the pot with the clips can be inserted into the hole 60 of the wall since there are no components which hinder this entrance. In this recessed position, the flange 22 of the pot contacts the outer surface 24 of the wall 26.

A pair of bolts 72 and 74, each having a head 76, 80 and a threaded stem 78, 82 are inserted in the pot with the threaded stems 78 and 82 extending through each threaded opening 46 of the upper end portion 34 of the clips. The inner wall 18 of the pot may have two rounded concavities 84 and 86 to receive the upper extremities 85 and 87 of the bolts 72 and 74. Alternatively, the bolts may threadedly engaged to the upper portions 34 of the clips prior to insertion into the wall opening.

Figure 4:
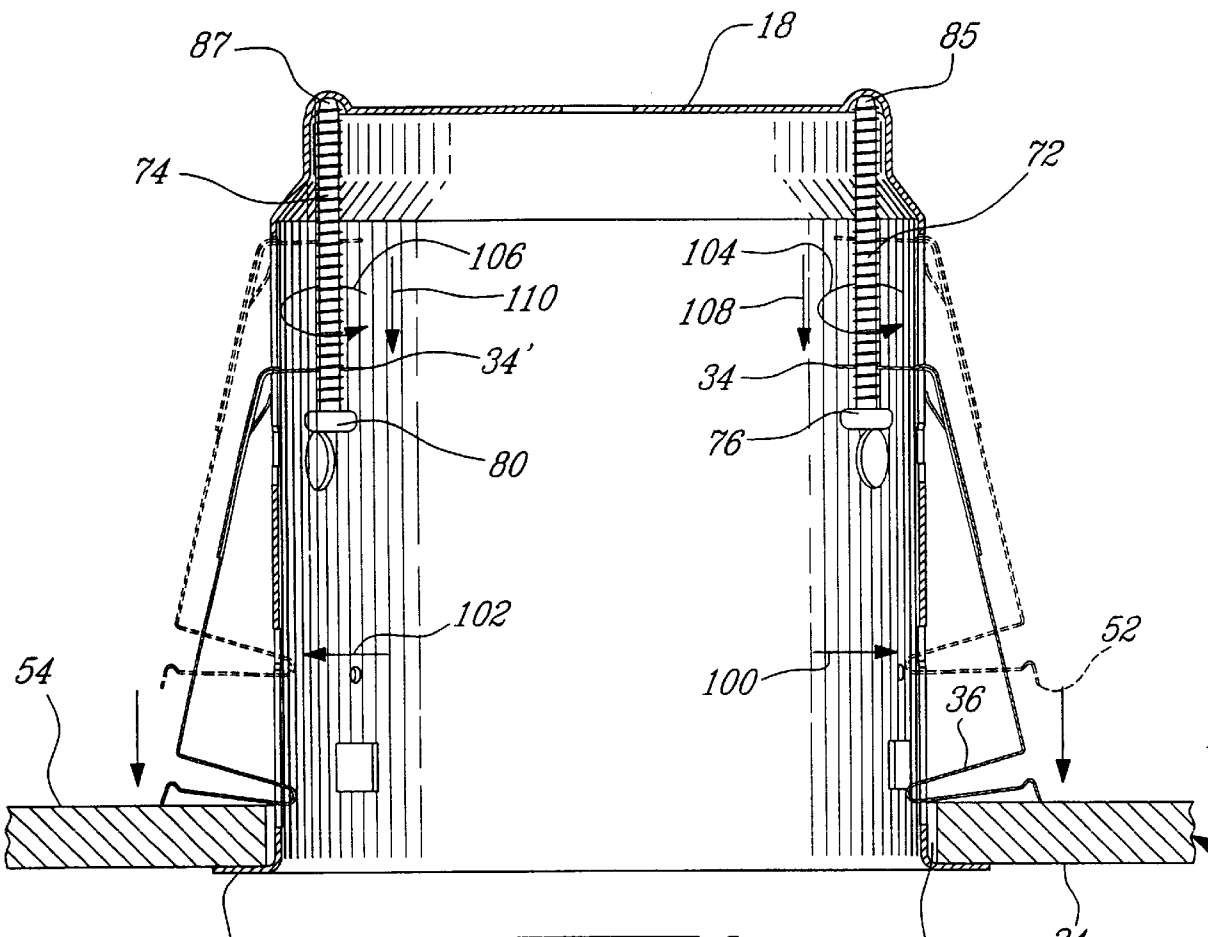
FIG. 4 is a cross-sectional view showing the fixation of the light fixture and illustrating the actuation of the retaining clips.

Referring to FIG. 4, once the pot and the clips are received within the wall, pressure is applied as indicated by arrows 100 and 102 to force outwardly the compressed V-shaped portion of the clips exteriorly where they occupy the position shown in dotted lines. With the assistance of a screw driver which engages the heads 76 and 80 of the bolts, rotation is applied as indicated by arrows 104 and 106 causing the upper connecting portions 34 of the clips to axially move downward as indicated by arrows 108 and 110 (bolts 72 and 74 do not move axially as a result of their extremities 85 and 87 contacting the inner wall 18 of the pot). The downward motion of the clips causes the clip portion 36 to move down the slot 28 (with the indentation areas 48, 50 and 48' sliding down the lower slot area 30*a*) until the extremities 52 of the clips contact the rear wall surface 54. Thus, the pot is securely fixed in the wall.

Preferably, the clip is made of metallic material in order to provide the spring action of the legs 36*a* and 36*b* at the lower end portion of the clip.

Although the invention has been described above with respect to a specific form, it will be evident to the person skilled in the art that it may be refined and modified in various ways. For example, although the slot means consist of a pair of aligned slots, a single slot could. It is therefore wished to have it understood that the present invention should not be limited in an interpretation except by the terms of the following claims.

What is claimed is:

1. A recessed light fixture for mounting into an opening made in a ceiling or wall defining a front wall surface and a rear wall surface, said fixture comprising:

a) a pot adapted to be received in said opening; said pot having an inner rear wall and a side wall; said side wall having an outer peripheral flange adapted to bear against said front wall surface when mounted in said opening; said side wall displaying slot means therethrough;

b) retaining clip means consisting of an elongated body having:

i) a main portion adapted to lie exteriorly along said side wall;

ii) an upper connecting portion extending substantially parallel to said inner rear wall of said pot and through said slot means; said upper connecting portion displaying a threaded hole therethrough;

iii) a lower spring portion defining a V-shape having a lower extremity adapted to contact said rear wall surface of said ceiling or wall; said spring portion being manually flexible inside said pot to move vertically between a compressed condition and a detent condition said spring portion formed of a pair of legs radially movable through said slot means and of a junction area lying inside said pot in either of said compressed and detent conditions;

c) an adjusting bolt having a head and an elongated threaded stem adapted to extend through said threaded hole of said upper connecting portion of said clip means and to contact said rear wall of said pot;

wherein said spring portion, in said compressed condition, is insertable in said slot means to extend in said pot and to secure said clip means in said side wall;

wherein said spring portion, in said detent condition, extends exteriorly of said side wall and over said rear wall surface of said ceiling or wall; and wherein rotation of said bolt causes said clip means to move longitudinally relative to said side wall and said lower and upper end portions of said clip to move longitudinally in said slot means until said lower extremity of said clip contacts said rear wall surface to fixedly install said pot in said ceiling or wall.

2. A light fixture as defined in claim 1, wherein said slot means consist of two vertically spaced slots.

3. A light fixture as defined in claim 2, wherein a lowermost of said slots defines a rectangular shaped opening; said opening having an enlarged entrance area for said lower spring portion of said clip means.

4. A light fixture as defined in claim 2, wherein an uppermost of said slots defines a rectangular shaped opening; said opening having an enlarged entrance area for said upper connecting portion of said clip means.

5. A light fixture as defined in claim 4, wherein said main portion of said clip means adjacent said upper connection portion displays spring deformations to secure said clip means to said pot.

6. A light fixture as defined in claim 1, wherein said clip means consist of a pair of clips disposed diametrically opposite to one another on said side wall of said pot.

7. A light fixture as defined in claim 1, wherein said clip is made of metallic material.

8. A recessed light fixture for mounting into an opening made in a ceiling or wall defining a front wall surface and a rear wall surface, said fixture comprising:

a) a pot adapted to be received in said opening; said pot having an inner rear wall and a side wall; said side wall having an outer peripheral flange adapted to bear against said front wall surface when mounted in said opening; said side wall displaying slot means therethrough;

b) retaining clip means consisting of an elongated body having:

i) a main portion adapted to lie exteriorly along said side wall;

ii) an upper connecting portion extending substantially parallel to said inner rear wall of said pot and through said slot means; said upper connecting portion displaying a threaded hole therethrough;

iii) a lower spring portion defining a V-shape and extending through said slot means; said spring portion having a lower extremity adapted to contact said rear wall surface of said ceiling or wall; said spring portion being flexible to move between a compressed condition and a detent condition;

c) an adjusting bolt having a head and an elongated threaded stem adapted to extend through said threaded hole of said upper connecting portion of said clip means and to contact said rear wall of said pot;

wherein said spring portion, in said compressed condition, is insertable in said slot means to extend in said pot and to secure said clip means in said side wall;

wherein said spring portion, in said detent condition, extends exteriorly of said side wall and over said rear wall surface of said ceiling or wall;

wherein rotation of said bolt causes said clip means to move longitudinally relative to said side wall and said lower and upper end portions of said clip to move longitudinally in said slot means until said lower extremity of said clip contacts said rear wall surface to fixedly install said pot in said ceiling or wall;

wherein said slot means consist of two vertically spaced slots;

wherein a lowermost of said slots defines a rectangular shaped opening; said opening having an enlarged entrance area for said lower spring portion of said clip means; and wherein said V-shape consists of a pair of legs and a junction area; said legs displaying a pair of opposite knotches adjacent said junction area; said knotches adaptable to slide along corresponding edges of said lowermost slot.

* * * * *